United States Patent [19]

Robinson

[11] 4,128,973

[45] Dec. 12, 1978

[54] METHOD AND APPARATUS FOR SECURING AND STABILIZING A LIGHTWEIGHT, COLLAPSIBLE STRUCTURE THAT IS MOVING ALONG A MOVING WORK SITE

[76] Inventor: Charles L. Robinson, 23 Bayou Shadows, Houston, Tex. 77024

[21] Appl. No.: 849,704

[22] Filed: Nov. 8, 1977

[51] Int. Cl.[2] ..... E04B 1/34; B60V 3/02

[52] U.S. Cl. ..... 52/2; 52/143; 180/115

[58] Field of Search ..... 52/2, 143, 741, 745; 180/115-117; 135/1 A, 3 A, 4 A, 5 A, 7.1 A

[56] References Cited

U.S. PATENT DOCUMENTS

| | | | |
|---|---|---|---|
| 3,433,470 | 3/1969 | Erke | 52/2 X |
| 3,744,191 | 7/1973 | Bird | 52/2 |
| 3,877,187 | 4/1975 | Livingston | 52/143 |
| 3,990,532 | 11/1976 | Robinson | 52/2 X |

*Primary Examiner*—J. Karl Bell

*Attorney, Agent, or Firm*—Arnold, White & Durkee

[57] ABSTRACT

Method and apparatus for securing and stabilizing a lightweight collapsible structure that is moving along a moving work site. Anchor tracks are securely anchored along each side of a moving work site. Stability lines connected to the platform of the lightweight structure connect with the anchor tracks. In this manner the structure is more stable and less susceptable to damage due to adverse weather conditions or lift forces caused by the superatmospheric condition resulting from the pressure differential needed to maintain the lightweight structure in an erect position.

9 Claims, 4 Drawing Figures

FIG. 2
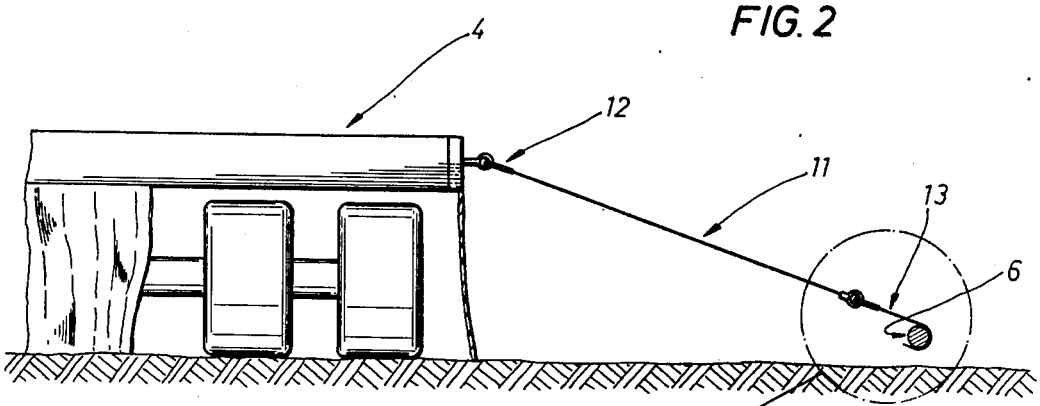
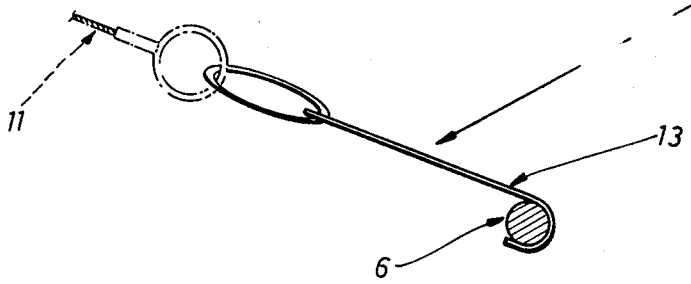
FIG. 2a
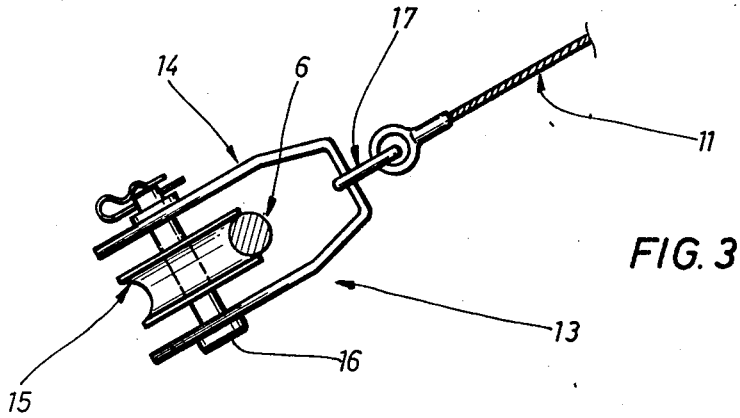
FIG. 3
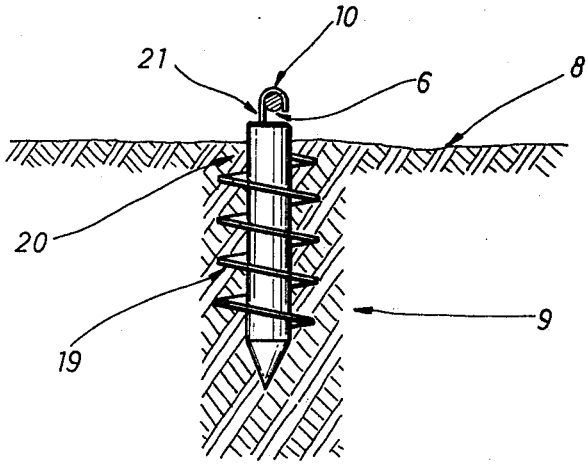
FIG. 4

METHOD AND APPARATUS FOR SECURING AND STABILIZING A LIGHTWEIGHT, COLLAPSIBLE STRUCTURE THAT IS MOVING ALONG A MOVING WORK SITE

FIELD OF THE INVENTION

This invention is directed towards an improved method and apparatus for securing and stabilizing a lightweight collapsible building structure adapted for the provision of being a controlled environment along a moving work site. I have found the need to provide a simple and efficient method of securing and stabilizing a protective environment along a moving work site such as the construction of a pipeline in areas where the weather conditions substantially interfere with outdoor construction. More particularly my invention is directed towards an improved means for stabilizing a lightweight, transportable collapsible structure against high winds caused by adverse weather conditions or excessive lift forces resulting from the superatmospheric condition maintained within the structure.

BACKGROUND OF THE INVENTION

My invention is an improvement in the manner of stabilizing and securing a controlled movable environment as disclosed in my prior U.S. Pat. No. 3,990,532 entitled "Method and Apparatus for Providing a Controlled Movable Environment" which issued Nov. 9, 1976. Construction of major commercial and industrial complexes can be seriously hampered by adverse weather conditions. The time loss can be a significant cost factor to a contractor. In several hostile weather regions of the world estimated construction time of a project is forecast based on prior recorded seasonal weather conditions. It is, therefore, highly desirable to have available a sheltered environment which can be easily and rapidly assembled. In addition, the sheltered environment can be relied on by the contractor in forecasting his construction schedule. Of all outdoor construction activity, pipeline installation, due to its continuously moving nature, appears most in need of a controlled environment which can be moved easily along the work site.

In the past, pipeline construction has been hampered by adverse weather conditions. Traditional practice has been to either construct the pipeline in the open environment or within a temporary type shelter which is then moved along the moving work site as progress continues being torn down and reerected at successive locations. While these practices exhibit some utility, the petroleum and construction industries have always felt that there was a definite need for significant advancement. Such an advancement has been provided for in my prior U.S. Pat. No. 3,990,532. A further improvement is now provided according to the present invention wherein the procedure of securing and stabilizing a lightweight collapsible structure for a controlled environment that is being moved along a moving work site is significantly improved thereby enhancing its mobile characteristic.

SUMMARY OF MY INVENTION

My invention is an improved method and apparatus of securing and stabilizing a lightweight collapsible structure as a controlled environment when displaced along a moving work site. I hereby incorporate by reference my prior U.S. Pat. No. 3,990,532 entitled "Method and Apparatus for Providing a Controlled Moveable Environment" issued Nov. 9, 1976 and all related references cited therein. In that patent I disclose an enclosed moveable environment capable of providing a controlled working condition free from the effects of adverse weather and chiefly comprised of a lightweight collapsible building structure attached to elongated platforms which run along the length of the lightweight structure. The structure is fabricated of thin flexible air impervious material and is maintained in an erected position by blowers or fans which supply air pressure in a regulated manner into the interior of the structure thereby creating a superatmospheric condition. Alternatively, the lightweight structure may be composed of a series of flexible tubular elements which are maintained in an inflated position by the same fans or blowers; however as disclosed in my prior patent, with the alternative method of fabrication the interior of the lightweight structure is at atmospheric pressure. The tubular elements are maintained under a superatmospheric condition. The structure may be constructed of both an impervious flexible material and tubular elements. The structure is advanced forward along the moving work site by a tractor tow device or it may be equipped to be self-propelled by mounting a motor directly on the platform engaging a series of low pressure tires below the platform. In order to reduce the effect of excessive wind forces on the structure and to permit passage through limited spaces, I have taught in my prior patent, a way to adjust the height-to-width ratio of the light-weight structure.

According to the present invention, the improvement is provided which comprises, in the first instance, providing a pair of anchor tracks, each on opposite sides of the work site and extending at least along the entire length of the light-weight building structure in a path generally parallel to the direction of anticipated movement of the controlled environment. These anchor tracks may comprise, for example, a series of augers, each having an appropriate connecting means, such as a hook, an eye of the like, at its head, which have been anchored into the ground along at least a portion of the anticipated length of the moving work site. In another embodiment, a horizontal, generally ground level, cable is securely anchored at predetermined intervals to the ground along opposite sides of the moving work site external to the lightweight building structure. As will be apparent to those skilled in the art, a combination of the cables and the ground augers referred to above may be utilized.

A plurality of stabilizng cables, hereinafter referred to sometimes a "stability lines" are secured to the structure of the controlled environment at suitable points positioned around the periphery of the controlled environment, or at least generally along the length of either side thereof. These stability lines, which may be nothing more than suitable lengths of rope or some other flexible, but strong, material are releasably attached to the anchor track in a manner so as to hold the structure of the controlled environment stable against the effect of excessive wind forces while at the same time being capable of moving along the anchor track with the controlled environment when it is desired to advance the controlled environment along the moving work site. In one preferred embodiment of the invention, the stability lines are also releasably attached to a cable or track means which is horizontally mounted along the outside of the platforms of the controlled environment structure in a manner such that some lateral movement may be permitted when that is desirable. In another embodiment the stability lines may consist essentially of a hook, which attaches to the anchor track, a connection mount to fasten the line to the platform, and a flexible line long enough to extend to the anchor track but remains somewhat taut. The hook may be of a J-shaped configuration or, as an alternate embodiment, a pulley block/sheave arrangement which reduces the frictional drag force between the cable and stability lines.

As will be apparent, to those skilled in the art, the stability lines may be attached to any reasonable point on the controlled environment structure, as for example the platform, the lightweight structure, or a cable which is mounted between the platforms on each side of the structure. The stability lines would still perform the same function as discussed above by attaching to the horizontal cable which is fastened to the augers regardless of where the stability lines were mounted. In calm weather conditions and with low superatmospheric pressure within the collapsible building, the structure may be advanced along the work site without a need for stabilizing it to the horizontal cable. If satisfactory operating conditions continue, the horizontal cable need not even be employed. When higher winds do approach, however, the operation can halt and the structure can be securely stabilized to the ground by attaching the stability lines directly to the pre-set augers which are located along both sides of the moving work site. Alternatively, the horizontal cables may be used in which case the operation may continue even under higher winds by securing the stability lines to the horizontal cables and allowing the stability lines to advance along the horizontal cables which are secured to the ground by the augers as the controlled environment structure advances along the moving work site.

The advancement of the stability lines along the anchor tracks as a means of providing stability is a unique feature of my invention. In addition, the entire advancement of the cables at periodic intervals as the structure approaches the end of the cables is another unique feature of my invention.

Therefore, it is a primary objective of my present invention to provide an efficient, simple, and safe method of stabilizing a lightweight, collapsible building structure used as a controlled environment as it moves along a moving work site.

It is another object of my present invention to provide an apparatus for securing and stabilizing a lightweight collapsible building structure used as a controlled environment as it moves along a moving work site.

Examples of the more important features of my invention have been summarized rather broadly in order that the detailed description that follows may be better understood and in order that the contribution to the art may be better appreciated. There are of course additional features of my invention that will be described hereafter and which will also form the subject of the appended claims.

BRIEF DESCRIPTION OF THE DRAWINGS

In order that the manner in which the recited features, advantages, and objectives in my invention as well as others, which will become apparent, are obtained and can be understood in detail, a better description of my invention briefly summarized above, may be had by a reference to the embodiments which are illustrated in the appended drawings and form a part of my specification.

It shall be noted that the appended drawings are not to be considered limiting the scope of my invention for my invention may admit to other equally effective embodiments without departing from its spirit and scope.

In the Drawings

FIG. 1 depicts an isometric view of the lightweight collapsible controlled environment structure in an inflated position being towed by a tractor tow means. Also shown is my present invention comprising anchor tracks straddling each side of the moving work site which connect with the stability lines stabilizing the structure.

Figure 1:
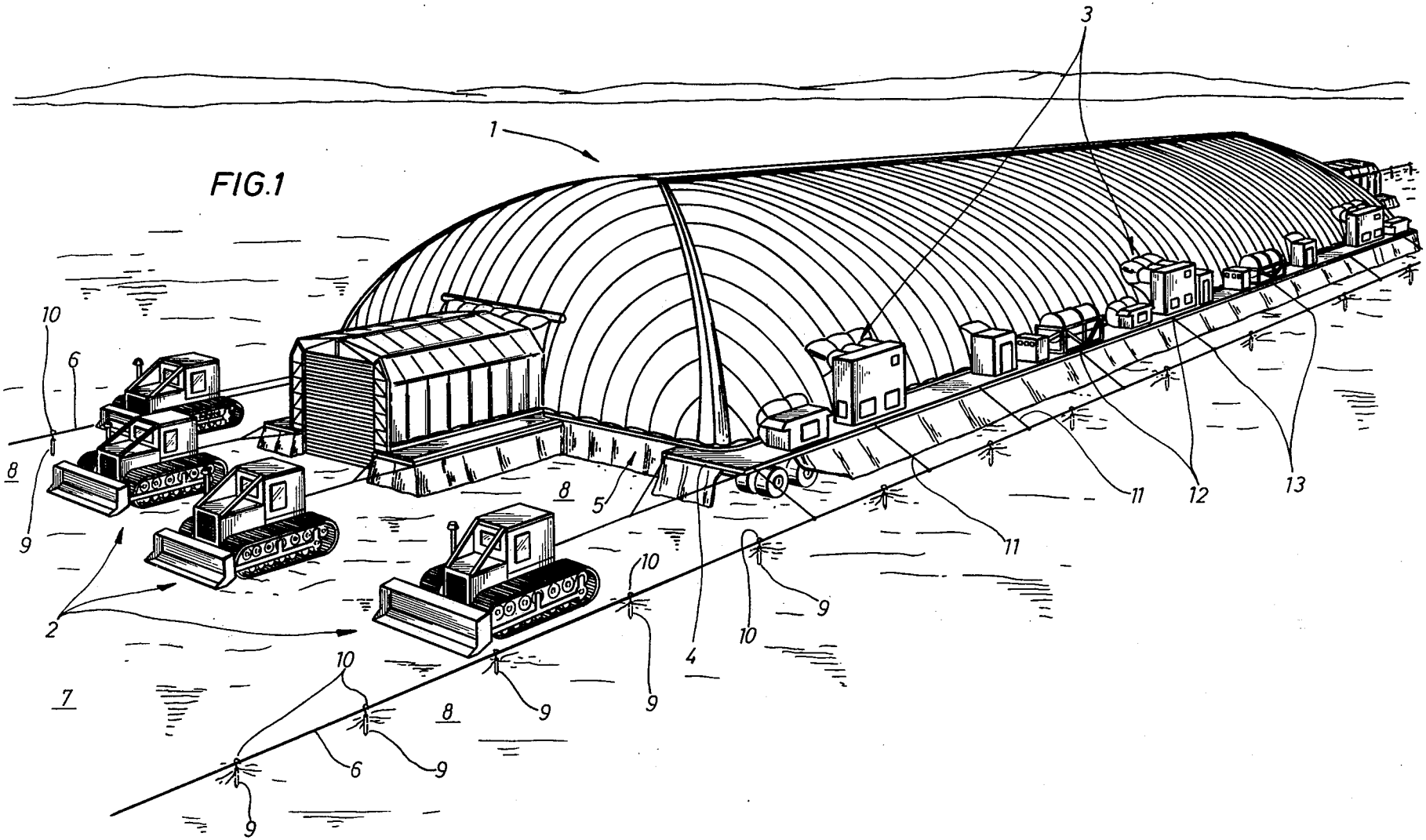

FIG. 2 is a detail of the stability line connected to the platform and the cable. FIG. 2*a* is a detail of the hook means attaching the stability line to the cable. In the preferred embodiment the hook means comprises a J-shaped element which loops around the cable.

FIG. 3 is a detail of my alternate embodiment depicting a hook means comprising a pulley housing/sheave arrangement.

FIG. 4 is a detail of the auger device shown securely anchored to the ground and attached to the cable.

DETAILED DESCRIPTION OF THE PREFERRED EMBODIMENTS

As introductory to a detail description of my present invention, several points should be made in view of my prior invention to exemplify the significance of my present invention. With respect to FIGS. 1 and 4 of my prior patent, the controlled environment is maintained in an erect position by a superatmospheric condition. To provide such a condition, air supply means, located on the platform, blows air into the lightweight structure keeping it in an erect attitude. A motor means drives a fan or blower discharging air into the interior of the structure. In my prior patent I also disclosed a pressure system whereby air from the motor means can be routed below each platform or sled by closing a valve forcing air under pressure between the sled and the ground surface, thereby suspending the sled off the ground. The sled is circumscribed by an apron which encloses a plurality of adjacent flexible fingers. The apron and adjustable flexible fingers assist in providing an effective air seal preventing a loss of pressure from the cushion of air. In this manner, the entire controlled environment can be moved horizontally along the work site with a minimal amount of pulling force. To stabilize the structure during adverse weather, or alternatively when the air pressure inside the structure causes a sufficient lift force to render the overall system unstable I disclosed and claimed a method wherein the direction of the blowers or fans mounted on the platform are reversed. Rather than providing a cushion of air, the reversal of the blowers results in a suction between the ground and the platform or sled. Consequently with the additional hold-down force available from the suction, the stability of the structure and platform is improved. My present invention is an improvement on stabilizing the controlled environment structure without the need of providing a suction.

Referring first to FIG. 1, there is depicted lightweight collapsible controlled environment structure 1 under tow by motive means 2. The controlled environment structure is advanced by similar motive means as disclosed in FIGS. 1 and 2 of my prior patent. A tractor towing device may be used to pull the structure, or the controlled environment structure may be equipped with self-propelling drive motors mounted on the platform. Low pressure tires are mounted on axles and secured within the platform providing a guide means and preventing laterial movement of the structure. The tires also provide a means of driving the structure if designed to be self-propelled. Alternatively, a plurality of keels may be used to prevent lateral drift of the structure rather than the use of the low pressure tires as shown in FIG. 7 of my prior patent. Turning back to FIG. 1 herein, air supply means 3, mounted on platform 4, keeps controlled environment structure 1, hereinafter referred to as "structure", erect. A perimeter apron 5 circumscribes structure 1 providing a seal between structure 1 and the contour of ground 8 thereby preventing a loss of air pressure. Also shown in FIG. 1 is my improved method of securing and stabilizing structure 1 under tow. Cables 6 and augers 9 are located adjacent both sides of moving work site 7. A cable 6 is located on each side of moving work site 7 and is anchored to ground 8 by augers 9. Augers 9 are connected to cable 6 by catch 10. Stability lines 11 are attached to platform 4 by connection mount 12 at periodic intervals along the length of structure 1. Lines 11 stabilize structure 1 by attaching to cable 6 via hook means 13.

With reference to FIGS. 2 and 2*a*, line 11 is attached to platform 4 by connecton mount 12. Line 11 attaches to hook means 13. In my preferred embodiment hook means 13 is a J-shaped member which loops around cable 6 to properly secure and stabilize structure 1. FIG. 2*a* illustrates in greater detail hook means 13. Due to its J-shaped, hook means 13 easily attaches around cable 6. Under severe wind conditions stability line 11 secures structure 1 by exerting a tension force on cable 6 through hook means 13. A plurality of hook means 13 would attach to cables 6 along both sides of structure 1. It will be apparent that the laterial forces exerted on structure 1 from adverse weather conditions or vertical lift forces resulting from the superatmospheric pressure condition within structure 1 are overcome by stability lines 11 securely attached to cables 6.

With respect to FIG. 3, an alternating embodiment of my hook means 13 is depicted which comprises pulley housing 14 and sheave 15. Sheave 15 is maintained in position by quick-disconnect pin 16. Pulley housing 14 is attached to line 11 by ring 17. Cable 6 rolls on sheave 15 as structure 1 advances along moving site 7. In this manner, virtually no friction is generated between hook means 13 and cable 6 thereby insuring that stability lines 11 will not drag on cable 6 during the forward movement of structure 1.

Turning to FIG. 4, auger 9 is shown in place securely anchored within ground 8. The pitch and root dimensions of vane 19 are standard within the industry. Catch 10 is attached to the upper end 20 of auger 9. Catch 10 remains above the surface of ground 8 after placement of auger 9. Cable 6 is fastened to ground 8 by engaging cable 6 within catch 10. Catch 10 comprises a J-shaped element with long side 21 towards structure 1. In this manner, any increase in the tension force from stability line 11 will not dislocate cable 6 from catch 10.

In the actual operation cables 6 are about 1 inch in diameter and are stretched out one or two miles adjacent the right-of-way of the moving work slight. The cables are parallel to one other and the moving work site. Each cable is secured at its ends, as for example by an auger. Alternatively, the cable may be kept taut by attaching one or both ends to a tractor or bulldozer. It is also anchored at predetermined intervals along its length, in most cases about every 10–50 feet in my invention, by additional augers. As will be appreciated, the actual interval will be a function of the internal air pressure of the structure, the wind velocities, the contour of the terrain, and related environmental and surface geological conditions. Cables 6 are spaced 10 to 15 feet further apart than the total width of the lightweight structure and platforms. Stability lines 11 are about one-half inch in diameter and spaced every 10–30 feet along the length of both sides of the lightweight structure.

Since the right-of-way of a moving work site is well known in advance of construction, the augers may be placed in presurveyed positions months in advance of the construction. This may be necessary in certain environmental conditions. For example, in locations where the ground surface is frozen for months out of the year the augers would be installed during the warmer months when the required "drilling-in" of the auger to properly anchor it is possible. Frozen ground is very difficult to drill in; yet, it is far more efficient to move heavy equipment for pipeline construction over frozen ground than it is to move the same equipment over thawed ground in warm weather.

After the augers are anchored and the cable secured within the catches, the lightweight structure is inflated and stabilized by the stability lines. The cable is not connected to those augers immediately adjacent the structure in order that the hook means of these stability lines will not interfere with the catch of each auger as the structure advances. In addition, the cable is not connected to those augers that are 100–200 feet in advance of the structure to allow for the forward movement of the structure without interference between the the stability lines and augers. As the structure passes an unhooked auger the cable is easily looped around the auger and secured within its catch. In this manner, the stability of the structure is maintained with a minimal amount of unhooked augers. If for some reason the directional movement of the structure must be reversed, the length of the cable immediately behind the structure is unhooked from those augers and the length of cable forward of the structure hooked. The structure can then be towed in reverse with the improved stability of my invention.

If the cables are anchored at each end to bulldozers, then the entire length of each cable is also advanced as the light-weight structure approaches the end of the cables thereby requiring only one set of cables to perform the task of stabilizing the structure during the construction operation. As the front bulldozer advances each cable and passes an auger, the cable is looped around it properly securing the cable. In a similar manner, the cable is released from each auger as the rear bulldozer approaches. The required clearance between the the center of the bulldozer and the top of the catch is predetermined to ensure that the catch is not damaged during passage of the bulldozer. Alternatively, the auger may be anchored deeper into the ground to ensure an adequate clearance.

With my alternate embodiment, the pulley housing/-sheave arrangement need only be connected one time since each auger is released from the cable as the stability lines advance with the structure. The sheave reduces the frictional force between the hook means and cable consequently reducing the drag force. Depending on the number of stability lines connected to the cables, the drag force may become a factor impeding the free movement of the structure. In that case, the use of my alternate embodiment would enhance the value of my invention.

I recognize that a more sophisticated pulley housing/sheave arrangement may be developed from my alternate disclosure as illustrated in FIG. 3. A "Ski-Lift" type block may be incorporated into my invention which would not require that the cable be released from the augers immediately adjacent the structure in order to avoid an interference between the stability lines and the augers.

My invention securely stabilizes a controlled moveable environment as claimed in my U.S. Pat. No. 3,990,532 when towed or self-propelled along a moving work site. The light-weight structure is securely anchored to the ground enhancing its ability to resist wind forces which might otherwise blow the structure down. In addition, the structure is able to withstand greater lift forces resulting from the superatmospheric pressure. The advancement of the stability lines along the cable is a unique means of securing and stabilizing the structure. More particularly, the periodic advancement of the cables as the structure reaches their ends is another unique feature of my invention.

Thus, it is apparent that there has been provided, in accordance with the invention, an improved method and apparatus of securing and stabilizing a lightweight collapsible structure used as a controlled environment along a moving work site. Based on the above description it is apparent that my invention substantially satisfies the objectives and advantages set forth above. Although the present invention has been described in conjunction with specific forms thereof, it is evident that many alternatives, modifications, and variations will be apparent to those skilled in the art in light of the foregoing disclosure. Accordingly, it is intended that all such alternatives, modifications, and variations which fall within the scope of the invention as defined in the appended claims be embraced thereby.

What I claim is:

1. A controlled environment structure for protection of a work area from any hostile effects of the atmospheric environment, said controlled environment structure being movable to selected positions along a moving work site and comprising:

platform means;

anchor tracks secured to the ground adjacent each side of said moving work site;

site engaging means;

said engaging means comprising a plurality of stability lines connected to said controlled environment structure and connected to said anchor tracks;

a lightweight building structure being attached to said platform means and providing a protective enclosure, said enclosure substantially containing said controlled environment, said lightweight building structure being formed of a thin flexible material maintained in erect condition responsive to maintenance of a superatmospheric pressure condition therein;

air supply means provided for in said controlled environment for maintaining a regulated superatmospheric pressure within said lightweight building structure at all times;

motive means being provided for said platform means and causing desired movement of said platform means and said lightweight building structure relative to said moving work site; and means for controllably adjusting the height-to-width ratio of said lightweight building structure.

2. A controlled environment structure according to claim 1 wherein said platform means includes elongated platforms located at the sides of said lightweight building structure and arranged to move in linear manner relative to said work site.

3. A controlled environment structure according to claim 2 wherein said anchor tracks includes a plurality of auger devices securely anchored within the ground at predetermined intervals along each side of said work site.

4. A controlled environment according to claim 3 wherein said anchor tracks further includes at least two cables connected to said auger devices, each cable on opposite sides of said moving work site.

5. A controlled environment structure according to claim 4 wherein said stability lines comprises:

hook means for connecting said line to said cable;

connection mount for securing said line to said controlled environment structure; and flexible line connecting said hook means to said connection mount.

6. A controlled environment structure according to claim 5 wherein said hook means comprises a J-shaped member.

7. A controlled environment structure according to claim 5 wherein said hook means comprises a pulley block/sheave arrangement.

8. A controlled environment structure for protection of a work site from any adverse effects of the environment moveable to selected positions along a moving work site and including a platform means, site engaging means, a lightweight building structure, air supply means for erection of said building structure, motive means to displace said structure, and means for controllably adjusting the height-to-width ratio of said structure, wherein the improvement comprises:

anchor tracks secured to the ground adjacent each side of said work site; and said site engaging means comprise a plurality of stability lines connected to said controlled environment structure and connected to said anchor tracks.

9. In the method for providing a movable controlled environment at an out-of-doors work site wherein a lightweight collapsible building structure is erected on movable platforms surrounding said work site and maintained in an erected position by regulating the air pressure within the interior of said collapsible building structure or within tubular support elements thereof or both and wherein means are provided for moving the platforms supporting said lightweight building structure relative to the location of the work site while the structure is in an erected position and for enhancing the stability of said lightweight structure, the improvement which comprises:

providing in a path generally parallel to the direction of anticipated movement of said controlled environment and external to said lightweight building structure, a pair of anchor tracks, each on opposite sides of the work site and extending at least along the entire length of said lightweight building structure;

securing to said controlled environment structure a plurality of stabilizing cables suitably positioned at points generally located around the periphery of the controlled environment; and releasably attaching each of said stabilizing cables to appropriate points along the length of each anchor track in a manner such that said cable will hold said controlled environment structure stable against the effect of excessive wind forces while at the same time being capable of securing said controlled environment to said anchor track when it is desired to move said controlled environment structure, or when said controlled environment structure is not being moved but is temporarily halted.

* * * * *